US010109925B1

(12) United States Patent
Mozaffar et al.

(10) Patent No.: US 10,109,925 B1
(45) Date of Patent: Oct. 23, 2018

(54) DUAL FEED SLOT ANTENNA

(71) Applicants: Nazia A. Mozaffar, San Diego, CA (US); John Harold Meloling, San Diego, CA (US); David Hurdsman, Spring Valley, CA (US)

(72) Inventors: Nazia A. Mozaffar, San Diego, CA (US); John Harold Meloling, San Diego, CA (US); David Hurdsman, Spring Valley, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 15/236,535

(22) Filed: Aug. 15, 2016

(51) Int. Cl.

| | |
|---|---|
| ***H01Q 13/10*** | (2006.01) |
| ***H01Q 9/04*** | (2006.01) |
| ***H01Q 1/48*** | (2006.01) |
| ***H01Q 1/36*** | (2006.01) |
| ***H01Q 5/35*** | (2015.01) |
| ***H01Q 5/40*** | (2015.01) |
| ***H01Q 5/42*** | (2015.01) |
| ***H01Q 21/29*** | (2006.01) |

(Continued)

(52) U.S. Cl.
CPC ..... *H01Q 13/10* (2013.01); *H01Q 1/36* (2013.01); *H01Q 1/48* (2013.01); *H01Q 5/35* (2015.01); *H01Q 5/40* (2015.01); *H01Q 5/42* (2015.01); *H01Q 5/45* (2015.01); *H01Q 9/0407* (2013.01); *H01Q 13/106* (2013.01); *H01Q 21/29* (2013.01); *H01Q 13/18* (2013.01)

(58) Field of Classification Search
CPC ..... H01Q 1/36; H01Q 1/48; H01Q 9/0407; H01Q 5/35; H01Q 5/42; H01Q 5/40; H01Q 5/45; H01Q 13/10; H01Q 13/106; H01Q 13/18; H01Q 21/29
USPC ..... 343/700 MS
See application file for complete search history.

(56) References Cited

U.S. PATENT DOCUMENTS 4,197,545 A * 4/1980 Favaloro ..... H01Q 13/106 343/700 MS
4,903,033 A * 2/1990 Tsao ..... H01Q 9/0414 343/700 MS (Continued)

OTHER PUBLICATIONS

Chair, R. et al., Microstrip Line and CPW Fed Ultra Wideband Slot Antennas With U-Shaped Tuning Stub and Reflector, Progress in Electromagnetics Research, PIER 56, pp. 163-182, 2006.

*Primary Examiner* — Dameon E Levi
*Assistant Examiner* — Ab Salam Alkassim, Jr.
(74) *Attorney, Agent, or Firm* — SPAWAR Systems Center Pacific; Arthur K. Samora; Kyle Eppele

(57) ABSTRACT

A dual feed slot antenna can include a ground plane formed with an aperture, and first feed and second feeds extending into the aperture. The first feed and second feed can extend into the aperture so that the first feed and second feed are coincident and out of phase with other. The first feed and said second feed can define a U-shaped stub, with a respective stub length, a stub width, a crossbar and a pair of stub tines defining a stub separation extending from the crossbar. The first feed and second feed can extend into the aperture so that each of the stub tines from a first feed are coincident the stub tines from the second feed. With this configuration, and with further selection of the said respective stub lengths, stub widths and stub separations, a symmetric omnidirectional radiation can be established for the antenna.

7 Claims, 11 Drawing Sheets

(51) Int. Cl.
*H01Q 5/45* (2015.01)
*H01Q 13/18* (2006.01)

(56) References Cited

U.S. PATENT DOCUMENTS 5,241,321 A * 8/1993 Tsao ..... H01Q 9/0435 343/700 MS
5,949,376 A * 9/1999 McDonald ..... H01Q 9/0457 343/700 MS
6,018,320 A * 1/2000 Jidhage ..... H01Q 1/36 343/700 MS
6,054,953 A * 4/2000 Lindmark ..... H01Q 1/38 343/700 MS
6,061,032 A * 5/2000 Sandstedt ..... H01Q 1/246 343/700 MS
6,130,648 A * 10/2000 Rulf ..... H01Q 13/10 343/767
6,292,153 B1 * 9/2001 Aiello ..... H01Q 1/36 343/767
6,317,094 B1 * 11/2001 Wu ..... H01Q 13/085 343/767
6,377,227 B1 * 4/2002 Zhu ..... H01Q 1/38 343/700 MS
6,466,176 B1 * 10/2002 Maoz ..... H01Q 1/243 343/702
6,806,839 B2 * 10/2004 Lo ..... H01Q 9/285 343/725
8,432,235 B2 * 4/2013 Yoshioka ..... H01Q 13/10 333/172
8,629,812 B2 * 1/2014 Jaffri ..... H01Q 13/18 343/767
9,391,375 B1 * 7/2016 Bales ..... H01Q 21/24
9,413,064 B2 * 8/2016 Loftus ..... H01Q 13/106
9,595,764 B2 * 3/2017 Loftus ..... H01Q 13/106
2003/0201944 A1 * 10/2003 Aikawa ..... H01Q 13/10 343/770
2004/0104859 A1 * 6/2004 Lo ..... H01Q 9/285 343/767
2007/0052587 A1 * 3/2007 Cheng ..... H01Q 9/0407 343/700 MS
2009/0002248 A1 * 1/2009 Zhao ..... H01Q 1/243 343/722
2009/0046027 A1 * 2/2009 Lin ..... H01Q 13/106 343/756
2009/0256653 A1 * 10/2009 Hung ..... H01Q 5/35 333/204
2010/0194644 A1 * 8/2010 Lin ..... H01Q 13/106 343/700 MS
2010/0265151 A1 * 10/2010 Chou ..... H01Q 1/2291 343/843
2011/0018782 A1 * 1/2011 Lu ..... H01Q 1/521 343/846
2013/0141296 A1 * 6/2013 Jaffri ..... H01Q 13/18 343/770
2014/0071005 A1 * 3/2014 Wang ..... H01Q 1/243 343/725
2014/0168025 A1 * 6/2014 Chang ..... H01Q 1/521 343/770
2014/0240191 A1 * 8/2014 Lee ..... H01Q 13/18 343/852
2014/0247190 A1 * 9/2014 Loftus ..... H01Q 13/106 343/767
2015/0022411 A1 * 1/2015 Ali ..... H01Q 1/50 343/793
2016/0079676 A1 * 3/2016 Chuang ..... H01Q 9/0407 343/770
2016/0372831 A1 * 12/2016 Loftus ..... H01Q 13/106
2017/0222305 A1 * 8/2017 Liu ..... H01Q 1/243
2017/0331195 A1 * 11/2017 Dummanli Oktar .... H01Q 1/48

* cited by examiner

DUAL FEED SLOT ANTENNA

FEDERALLY SPONSORED RESEARCH AND DEVELOPMENT

The United States Government has ownership rights in this invention. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil, referencing NC 103511.

FIELD OF THE INVENTION

The present invention pertains generally to antennas and methods. More specifically, this invention pertains to wide bandwidth slot antennas. The invention is particularly, but not exclusively, useful as a wideband, small and lightweight slot antenna having a very symmetric radiation pattern up to the upper end of Ku band.

BACKGROUND OF THE INVENTION

For many antennas, wideband radiofrequency (RF) performance can be a desirable trait when developing a fieldable antenna and structure design. Platform design requirements can also be derived from antenna coverage and stability requirements. A small, lightweight planar antenna design with reduced size and weight requirements can further often be a desirable design parameter for antennas.

Patch antennas with a single feed are known in the prior art to meet the above parameters. Prior art single feed slot antennas can be designed so that a 3:1 bandwidth can be obtained. But for single feed slot antennas, the radiation patterns at high frequency ends of the bandwidth can be uneven and asymmetric. What is desired is a slot antenna with wideband performance, but with an even current distribution around the slot over the entire design frequency range, in order to obtain symmetric radiation patterns at high frequencies, which can further result in increased performance.

In view of the above, it can be an object of the present invention to provide a dual feed slot antenna with a uniform current distribution around the slot. Another object of the present invention can be to provide a dual feed slot antenna with symmetric radiation patterns throughout its design bandwidth of operation. Still another object of the present invention can be to provide a dual feed slot antenna which has comparable performance both at the low end and the high end of its design bandwidth. Still another object of the present invention can be to provide a dual feed slot antenna that can be relatively easy to manufacture, that can be used in a cost-effective manner, and that can be durable.

SUMMARY OF THE INVENTION

A dual feed slot antenna according to several embodiments of the present invention can include a ground plane formed with an aperture, and a first feed and a second feed extending into the aperture. The first feed and second feed can extend into the aperture so that the first feed and second feed are coincident with and out of phase with each other. To be out of phase, the first feed and said second feed can define a U-shaped stub, with a respective stub length, a stub width and a pair of stub tines defining a stub separation. The first feed and second feed can extend into the aperture so that each of the stub tines from a first feed are coincident with axes that are coincident with stub tines from the second feed. With this configuration, and with further selection of the said respective stub lengths, stub widths and stub separations, a symmetric omnidirectional radiation can be established for the antenna.

BRIEF DESCRIPTION OF THE DRAWINGS

The novel features of the present invention will be best understood from the accompanying drawings, taken in conjunction with the accompanying description, in which similarly-referenced characters refer to similarly-referenced parts, and in which.

DETAILED DESCRIPTION OF THE EMBODIMENTS

Figure 1:
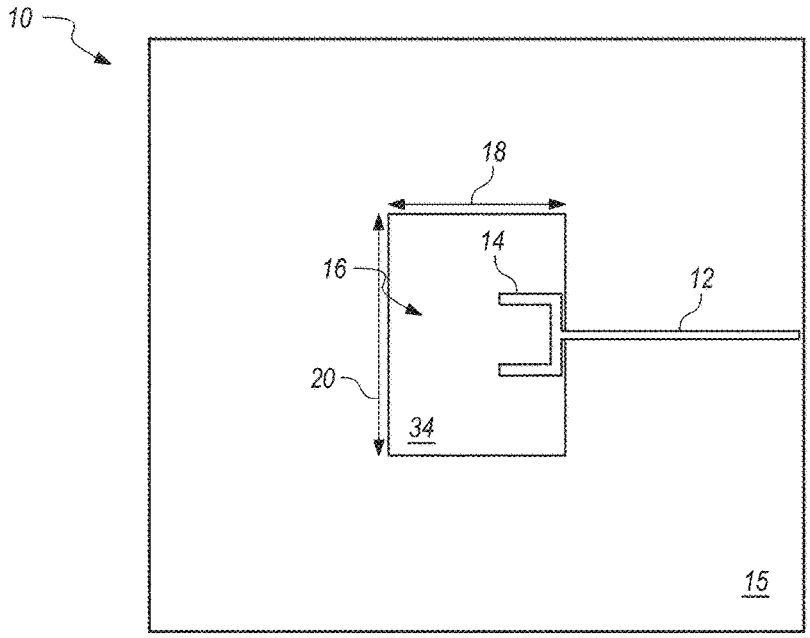
FIG. 1 (Prior Art)
FIG. 1 is a top plan view of a prior art single feed slot antenna.
Figure 2A:
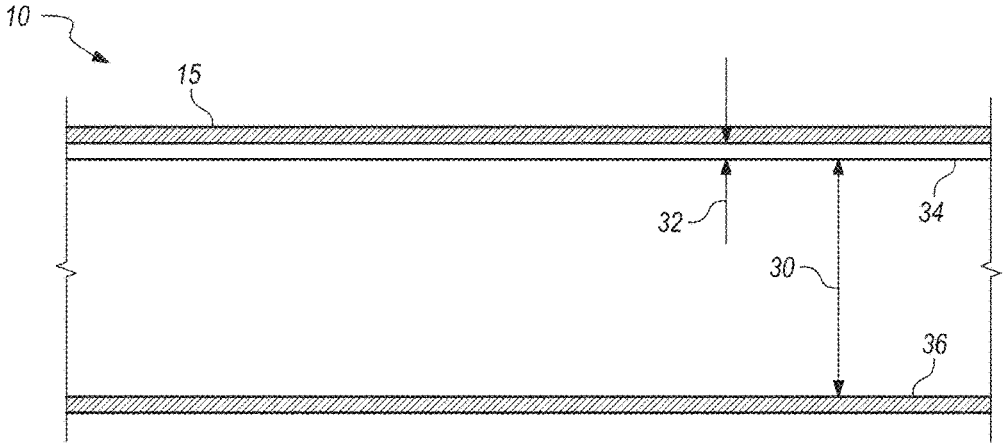
FIG. 2A (Prior Art)
FIG. 2A is a cross-sectional view of the prior art antenna of FIG. 1.
Figure 2B:
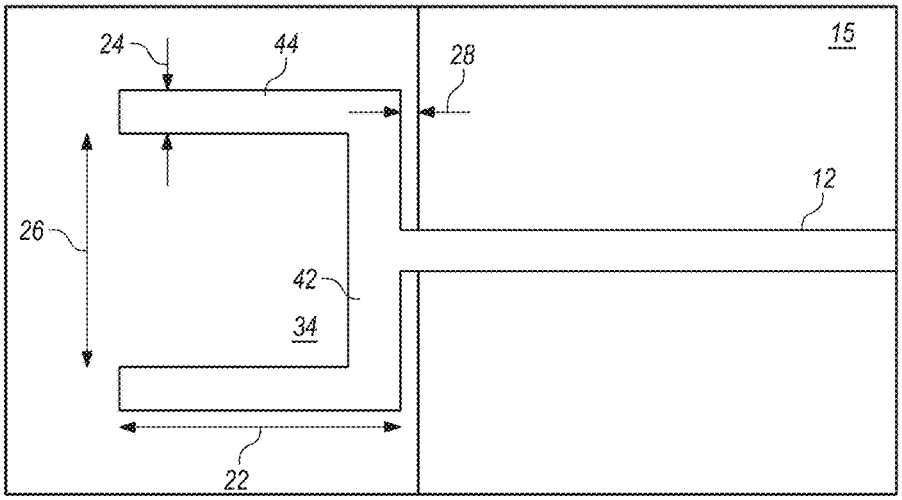
FIG. 2B (Prior Art)
FIG. 2B is an enlarged top plan view of the feed portion of the prior art antenna of FIG. 1.

In brief overview, slot antennas in the prior art can have bidirectional radiation patterns and a reflector can be added on the back to make the pattern unidirectional. Wideband performance could be achieved by using different slot and tuning stub shapes. Referring now to FIGS. 1, 2A and 2B, an antenna 10 from the prior art is shown. Antenna 10 can have a microstrip line feed 12 that can terminate in a U-shaped tuning stub 14. U-shaped tuning stub 14 can be chosen to obtain an impedance bandwidth ratio of 3:1.

As shown in FIGS. 1, 2A and 2B, the design variables for prior art antenna 10 can include variables pertaining to a ground plane 15 and a slot 16 formed in the ground plane. The slot 16 can be sized so that U-shaped stub 14 can be located in the slot 16. More specifically slot 16 can have a slot width 18 and a slot length 20, and the slot width 18, and slot length 20 can be manipulated, as well as the feed length 22, the feed width 24, and the feed separation 26 of feed 12 (FIG. 2B) to achieve a desired antenna performance. The distance between an edge of slot 16 along slot width 18 and U-shaped stub 14, or the stub-gap 28 (FIG. 2B) can also be used. Prior art antenna 10 is also shown with reflector 36 at an offset distance 30 from substrate 34. The offset distance 30 (FIG. 2A), and the thickness 32 of substrate 34 can also be used as design parameters.

As shown in FIGS. 1 and 2B, U-shaped stub 14 can have a crossbar 42 and a pair of tines 44 that can extend from crossbar 42 to form the U-shape. U-shaped stub 14 can further have a decreasing taper, from a maximum width proximate crossbar 42 to a minimum width where feed 12 first intersects ground plane 15 (taper not shown in FIG. 2B). Stepped matching using different widths of 12 can also be used vice a decreasing taper. The distance from feed 12 to an antenna excitation port (not shown) can also be sized for better return-loss matching.

For materials of prior art antenna 10, ground plane 15 can be made of a conductive material such as copper or similar type of material, while a material with a lower dielectric constant can be used for substrate 34. One such material is Arlon 25N, manufactured by Arlon Materials for Electronics. Arlon 25N has low dielectric constant and loss properties, and a 12 mil thickness was selected based on antenna return loss performance. Other materials with similar dielectric constants could be used. The final dimension of the prior art antenna 10 can be a ground plane 15 measuring 2.3×2.3 inches with a slot length 20 of 0.950 includes and a slot width 18 of 0.631 inches. A reflector 36 offset distance 30 of 0.2 inches below the slot 16 (ground plane 15) can be used.

Figure 3A:
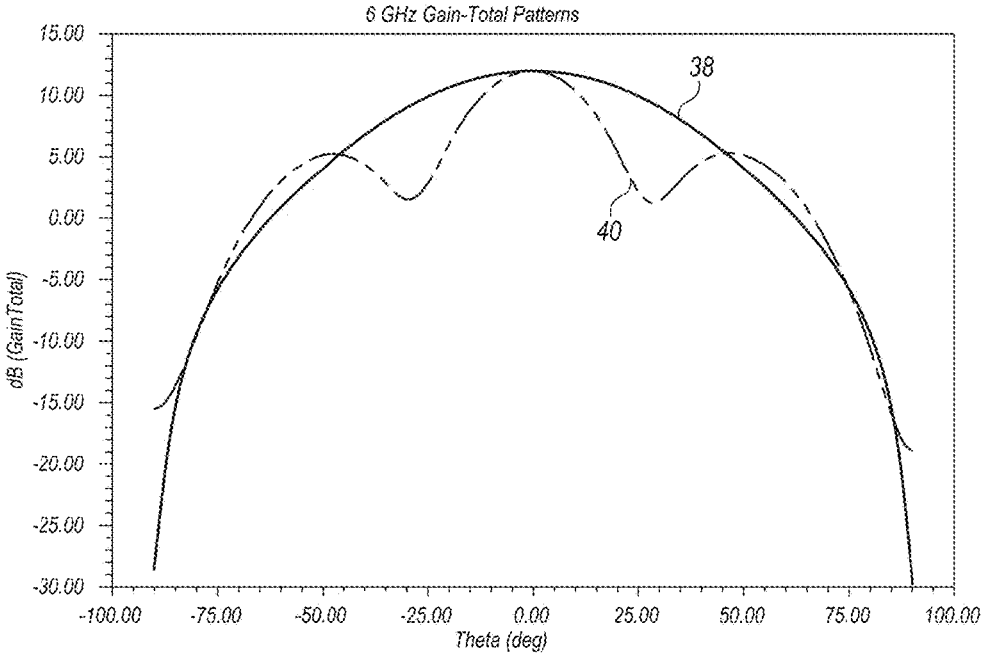
FIG. 3A (Prior Art)
FIG. 3A is a graph of the gain pattern for the prior art antenna of FIG. 1 when radiating at 6 GHz.
Figure 3B:
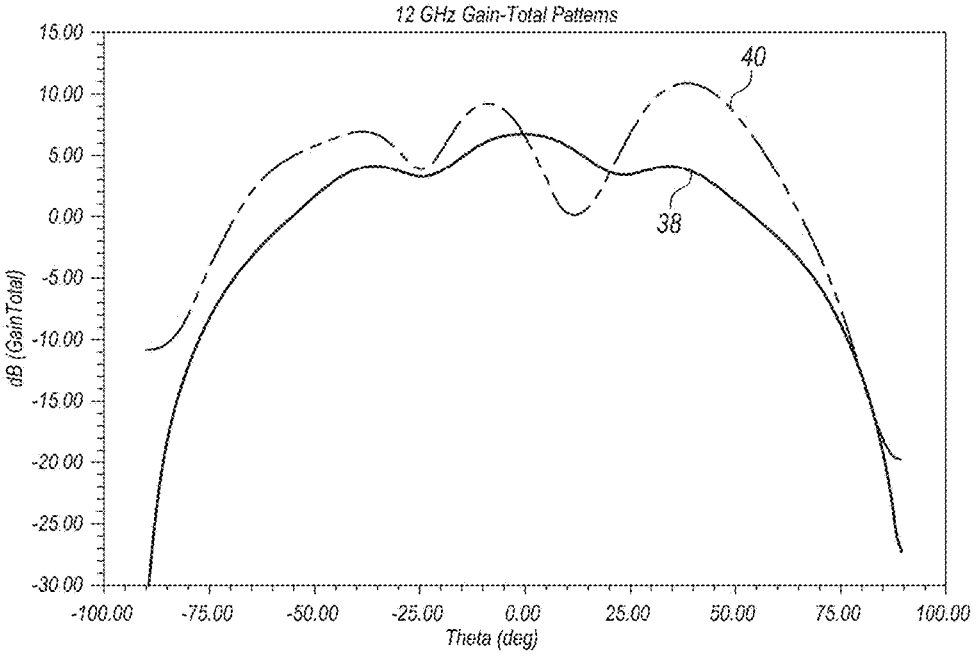
FIG. 3B (Prior Art)
FIG. 3B is a graph of the gain pattern for the prior art antenna of FIG. 1 when radiating at 12 GHz.
Figure 3C:
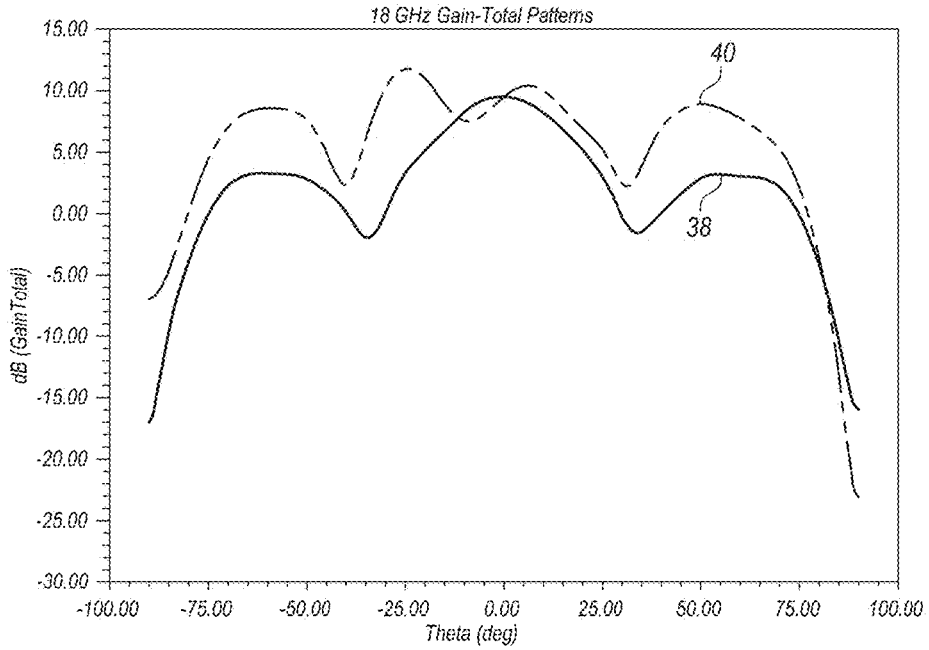
FIG. 3C (Prior Art)
FIG. 3C is a graph of the gain pattern for the prior art antenna of FIG. 1 when radiating at 18 GHz.
Figure 4A:
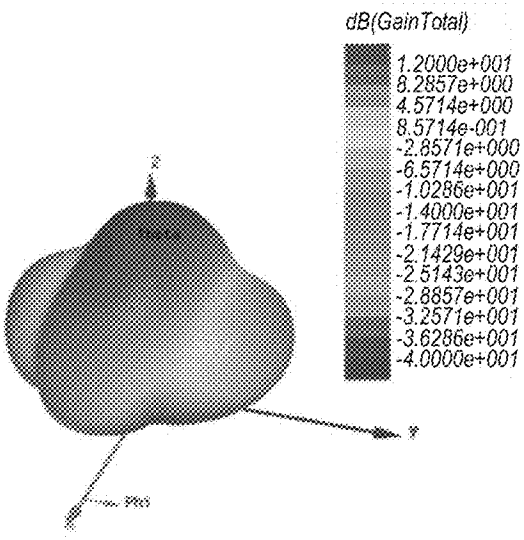
FIG. 4A is a three-dimensional color depiction of the gain pattern for the prior art antenna of FIG. 3A.
Figure 4B:
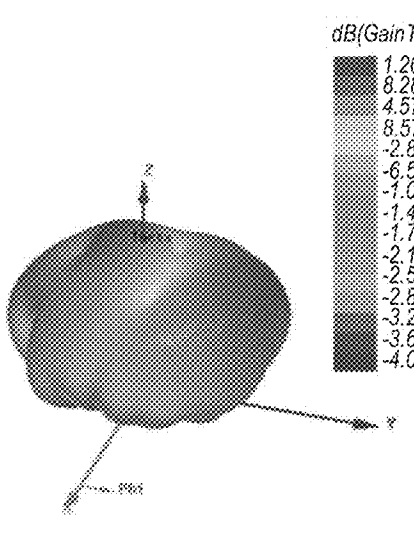
FIG. 4B is a three-dimensional color depiction of the gain pattern for the prior art antenna of FIG. 3B.
Figure 4C:
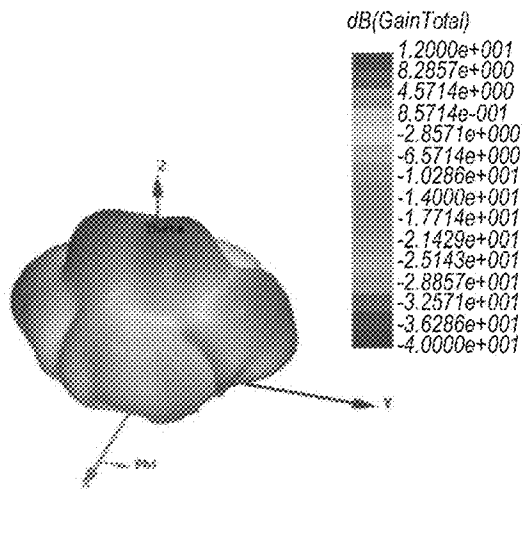
FIG. 4C is a three-dimensional color depiction of the gain pattern for the prior art antenna of FIG. 3C.

Referring now to FIGS. 3A-3C, 4A-4C and 5, the performance of the prior art antenna 10 described above in one frequency band of interest (the Ku band) is shown. FIGS. 3A-3C are graphs of the radiation patterns in the two principle planes of $\varphi=0°$ and $\varphi=90°$, i.e. the H-planes (curves 38) and the E-planes (curves 40). FIG. 3A is in the middle of the C band (6 GHz), FIG. 3B is near the beginning of the Ku band (12 GHz), and FIG. 3C is at the high end of the Ku band (18 GHz). From FIGS. 3A-3C, it can be seen that, particularly at the high end of the Ku band (FIG. 3C), the prior art antenna can have an asymmetrical radiation pattern (a symmetrical pattern would be indicated by a bell-shape curve for curves 38, 40 in FIGS. 3A-3C Three dimensional modeling of the radiation patterns of prior art antenna 10 at 6, 12 and 18 GHz can be seen in FIGS. 4A-4C, respectively. As can be seen by FIGS. 4A-4C, the radiation patterns for prior art antenna 10 at high frequencies (particularly at the high end of the Ku band, FIG. 4*c*) can be uneven and asymmetric, as indicated by the change in colors and the lack of uniform, half-spherical shapes in the three-dimensional representations of FIGS. 4A-4C (and again, particularly at 18 GHz, FIG. 4C).

Figure 5:
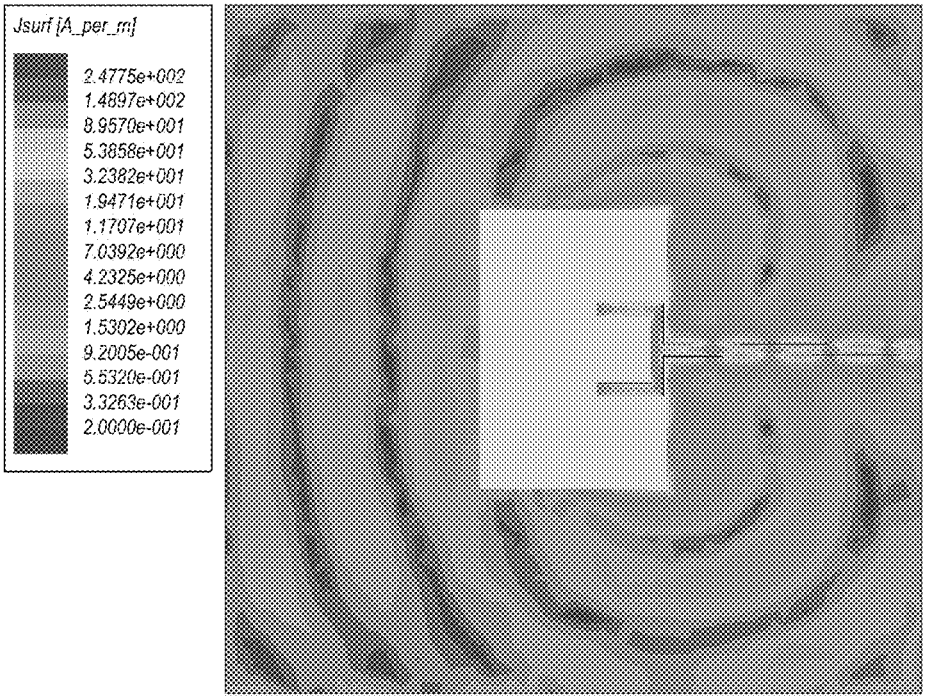
FIG. 5 (Prior Art)
FIG. 5 is a top plan color representation of the induced current formed when operating the prior art antenna of FIG. 1.

One reason for this asymmetric radiation pattern can be that the current distribution to slot 16 can be uneven. FIG. 5 is a top plan color representation of the current distribution across the length of the slot during operation of prior art antenna 10. As can be seen by the asymmetric (non-circular) pattern in FIG. 5, which is not symmetrical around U-shaped stub 14, or slot 16, an asymmetric current is being provided, which can further result in the aforementioned asymmetric radiation patterns of FIGS. 3A-4C.

Figure 6:
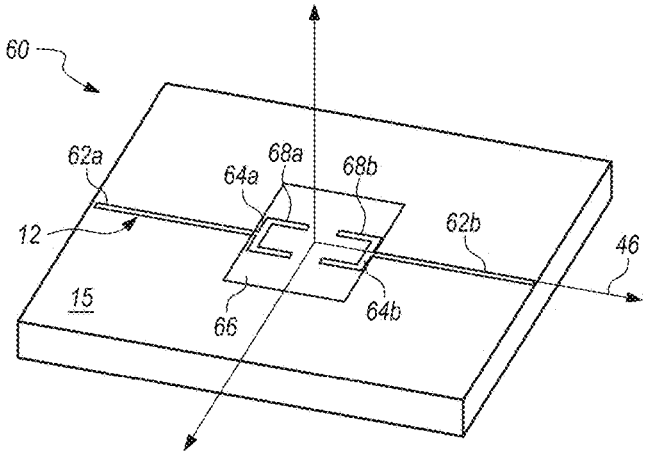
FIG. 6 is a side elevational view of the dual feed slot antenna of the present invention according to several embodiments.

In order to obtain a more symmetrical current distribution and referring now to FIG. 6, a dual-feed slot antenna 60 of the present invention according to several embodiments can be seen. As shown in FIG. 6, two antenna feeds 62*a*, 62*b* can be provided. The feeds 62*a*, 62*b* can be structured so the feeds 62 can extend into slot 66 from opposite sides of the slot 66, as shown in FIG. 6. Further, the feeds 62 can be fed 180° out of phase from each other. With this configuration, feeds 62*a*, 62*b* can be coincident with the same axis 46, and the respective tines 68*a*, from U-shaped stub 64*a* can also be coincident with axes that are coincident with axes that are coincident with tines 68*b* from U-shaped stub 64*b*. Once the dual slot feed configuration of the present inventions is achieved to obtain a symmetrical omni-directional radiation pattern, the above-cited antenna slot width, slot length, feed length, feed width/separation, stub gap and offset distance parameters can be adjusted to maintain the desired return and VSWR for the antenna.

Figure 7A:
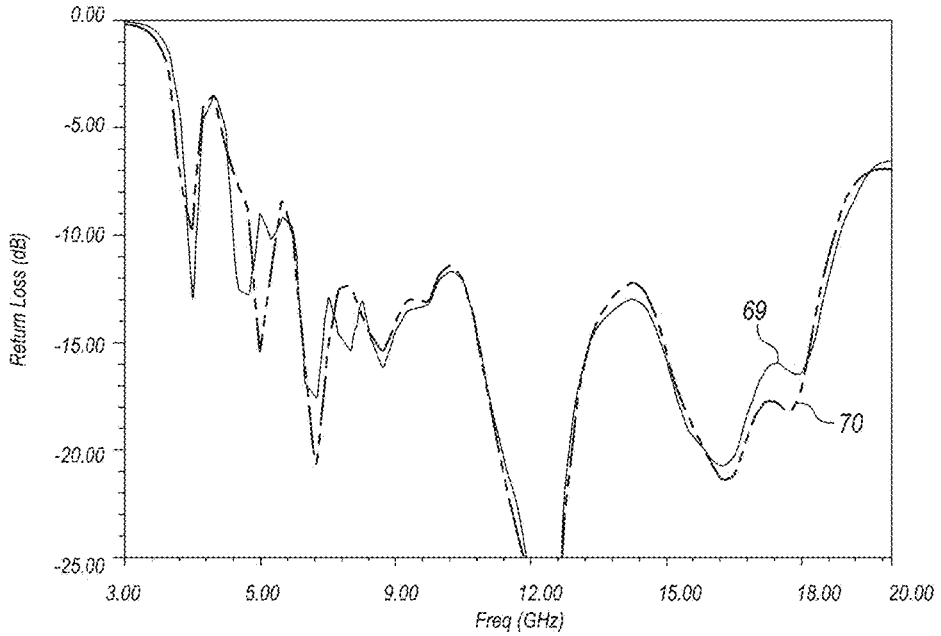
FIG. 7A is a graph of the antenna return loss for the antenna of FIG. 6, when compared to the prior art antenna of FIG. 1.
Figure 7B:
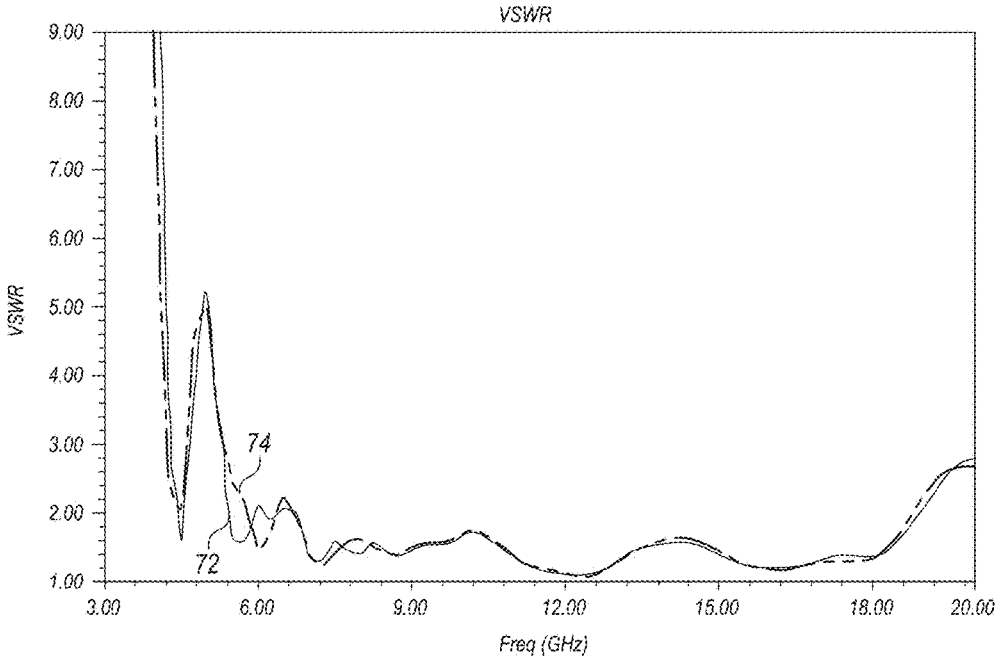
FIG. 7B is a graph of the voltage standing wave ratio (VSWR) for the antenna of FIG. 6, when compared to the prior art antenna of FIG. 1.

Referring now to FIGS. 7A and 7B, return loss and VSWR graphs are shown for the prior art antenna 10 when compared to the antenna 60 of the present invention. Interestingly, and as shown by curves 69 and 70 in FIGS. 7A-7B, despite the addition of a feed 12*a* that is completely out of phase with feed 12*b*, the addition of the out of phase feed has a minimal effect on the return-loss for the antenna 60. Similarly, VSWR (curves 72 and 74 in FIG. 7B) are minimally affected.

Figure 8A:
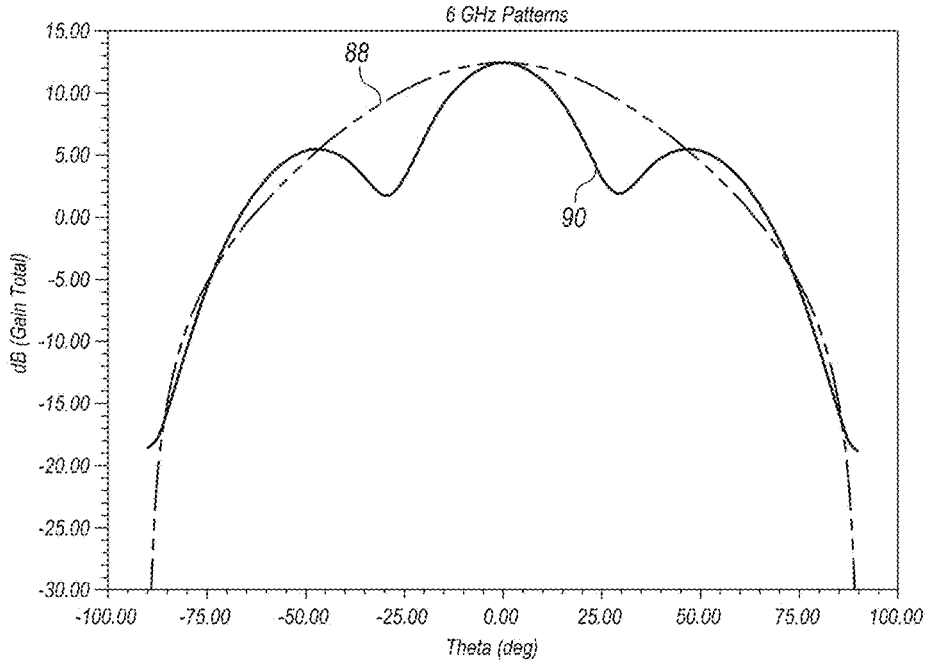
FIG. 8A is a graph of the gain pattern for the antenna of FIG. 6 when radiating at 6 GHz.
Figure 8B:
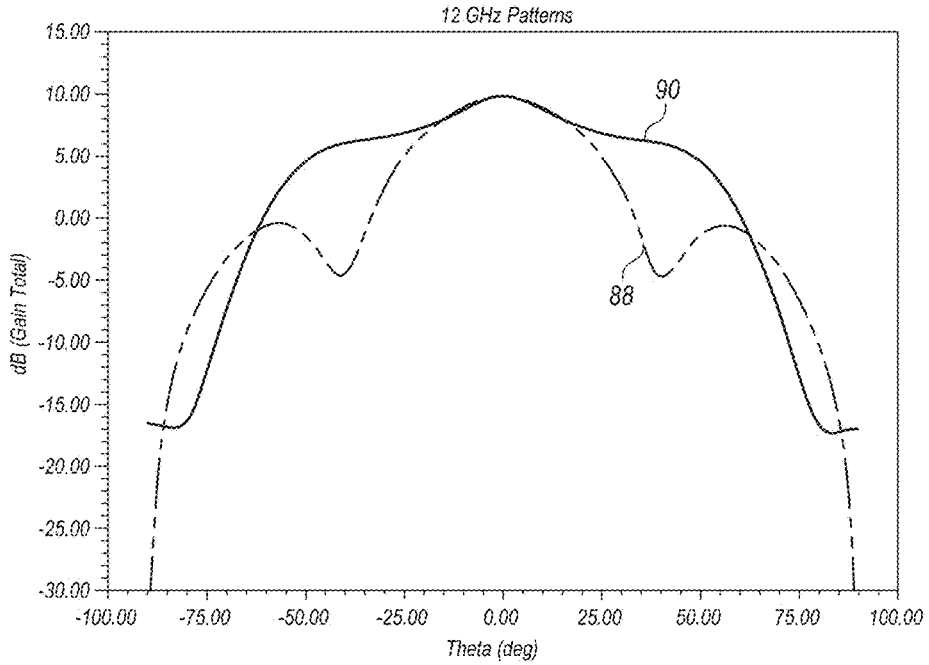
FIG. 8B is a graph of the gain pattern for the antenna of FIG. 6 when radiating at 12 GHz.
Figure 8C:
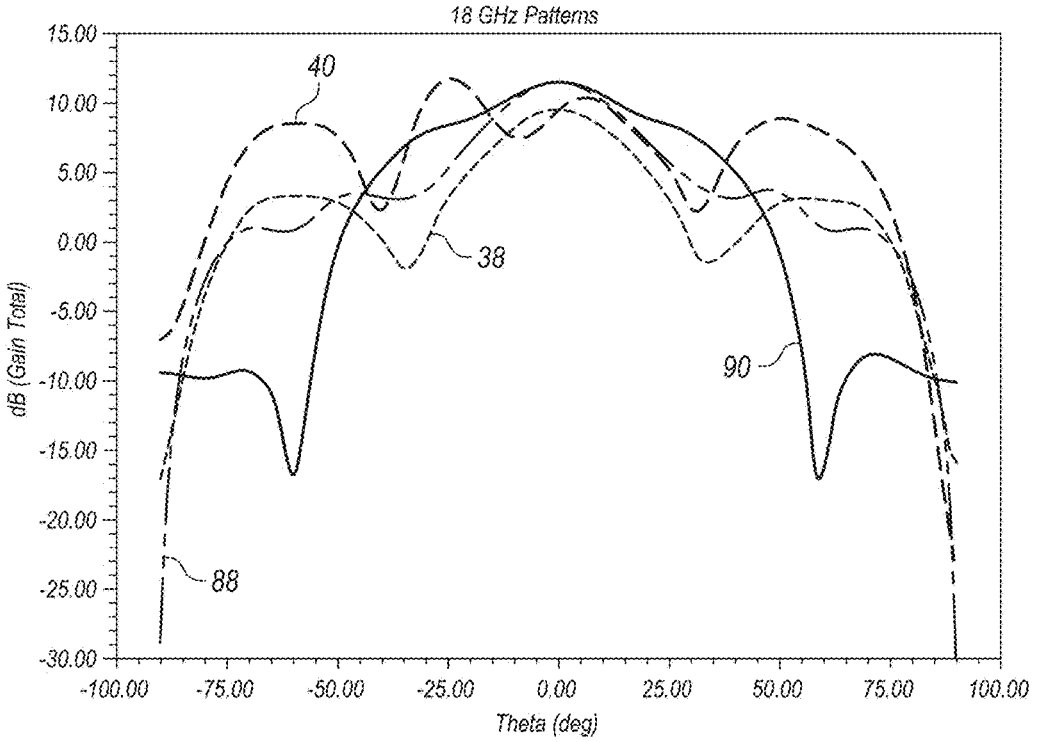
FIG. 8C is a graph of the gain pattern for the antenna of FIG. 1 and FIG. 6 when radiating at 18 GHz.

From the above, it can be inferred that the addition of the out of phase feed did not appreciably affect the power out of the antenna 60 when compared to a prior art antenna 10 having similar parameters. But the symmetry of the radiation patter is much improved. Referring now to FIGS. 8A-8C, 9A-9C and 10, the performance of the dual feed antenna 60 described above in one frequency band of interest (the Ku band) is shown. FIGS. 8A-8C are graphs of the radiation patterns in the two principle planes of $\varphi=0°$ and $\varphi=90°$, i.e. the H-planes (curves 88) and the E-planes (curves 90). Curves 38 and 40 from prior art antenna 10 are also shown for comparison. FIG. 8A is in the middle of the C band (6 GHz), FIG. 8B is at the near the beginning of the Ku band (12 GHz), and FIG. 8C is at the high end of the Ku band (18 GHz). From FIGS. 8A-8C, it can be seen that, particularly at the high end of the Ku band (FIG. 8C) and particularly in the H-plane, the prior art antenna has a much more asymmetrical radiation pattern when compared to the prior art radiation patterns (curves 38, 40 in FIGS. 3A-3C). Prior art curves 38, 40 and included in FIG. 8C for comparison to curves 88 and 90.

Figure 9A:
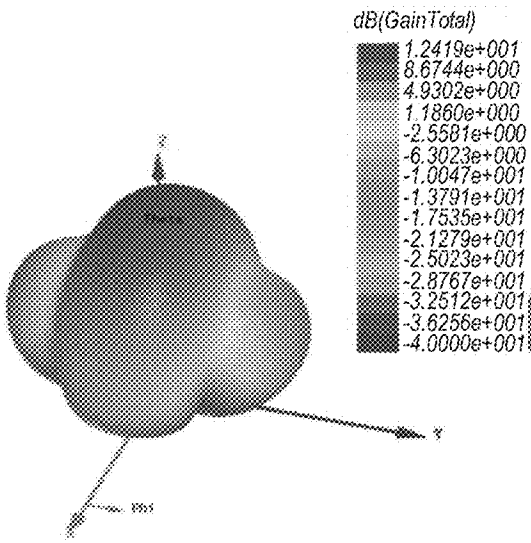
FIG. 9A is a three-dimensional color depiction of the gain pattern for the antenna of FIG. 8A.
Figure 9B:
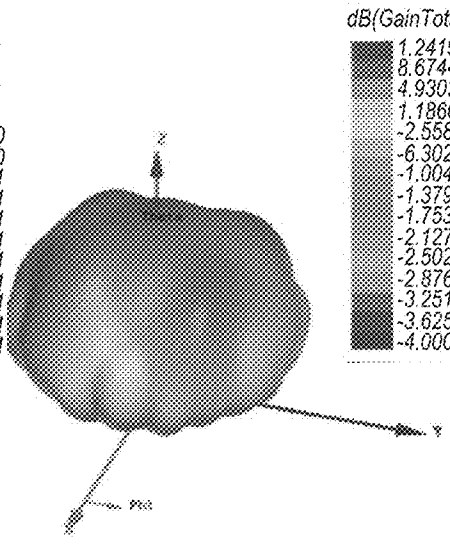
FIG. 9B is a three-dimensional color depiction of the gain pattern for the antenna of FIG. 8B.
Figure 9C:
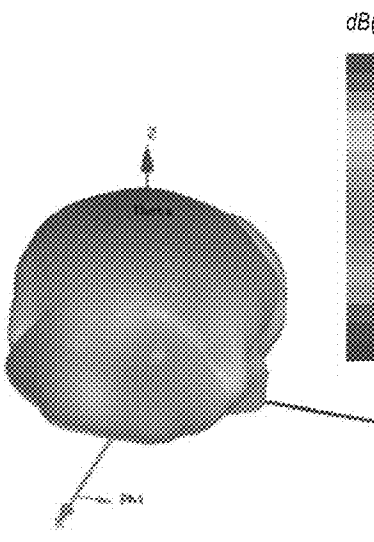
FIG. 9C is a three-dimensional color depiction of the gain pattern for the antenna of FIG. 8C.

Three dimensional modeling of the radiation patterns of antenna 60 of the present invention at 6, 12 and 18 GHz can be seen in FIGS. 9A-9C, respectively. As can be seen by FIGS. 9A-9C, the radiation patterns for antenna 10 at high frequencies (particularly at the high end of the Ku band, FIG. 9C) for the dual out of phase feed configuration can be much more symmetric, as indicated by the more uniform spherical shapes in the three-dimensional representations of FIGS. 9A-9C (and again, particularly at 18 GHz, FIG. 9C), especially when compared to the representations shown in FIGS. 4A-4C. One reason for this asymmetric radiation pattern can be that on the current distribution to slot 16 is uneven.

Figure 10:
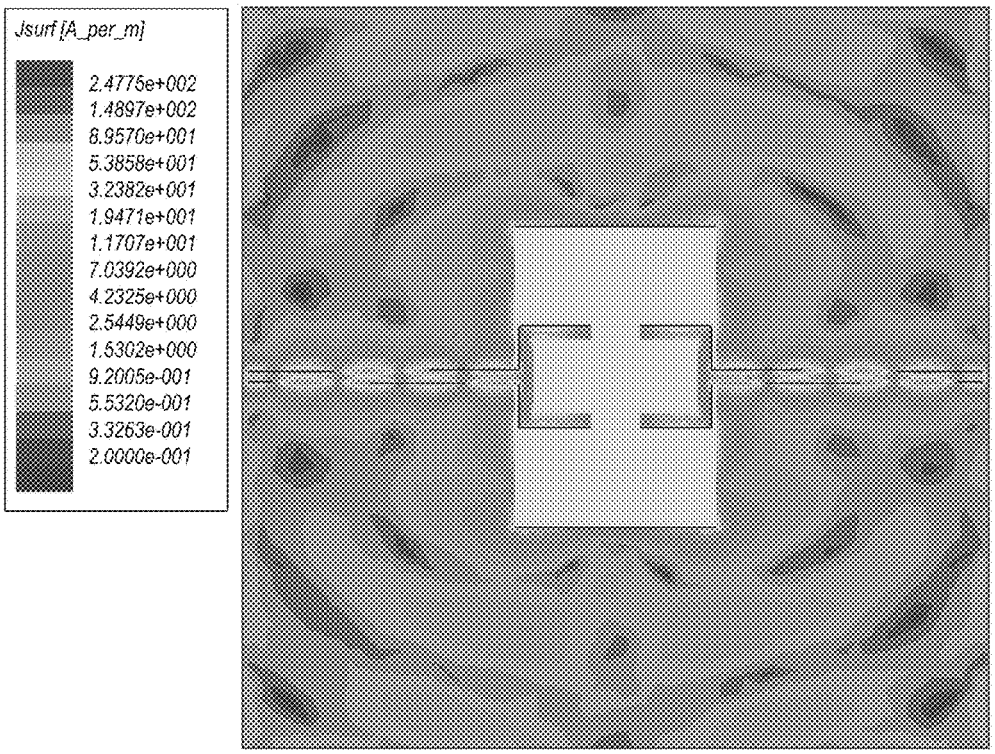
FIG. 10 is a color representation in top plan of the induced current formed when operating the antenna of FIG. 6; and, FIG. 11 is block diagram of steps that can be taken to accomplish the methods of the present invention according to several embodiments.

FIG. 10 is a top plan color representation of the current distribution across the length of the slot. As can be seen by the circular pattern in FIG. 10, which is substantially symmetrical around slot 16, a symmetric current distribution can be accomplished by the antenna 60 of the present invention, which can further result in the aforementioned symmetric radiation patterns of FIGS. 8A-8C and 9A-9C.

The above shows the comparison between patterns from single-feed and dual-feed antennas in the principle planes. The dual-feed approach is a new and unique method of feeding a slot antenna, it can help in obtaining a more even and symmetric current distribution.

Figure 11:
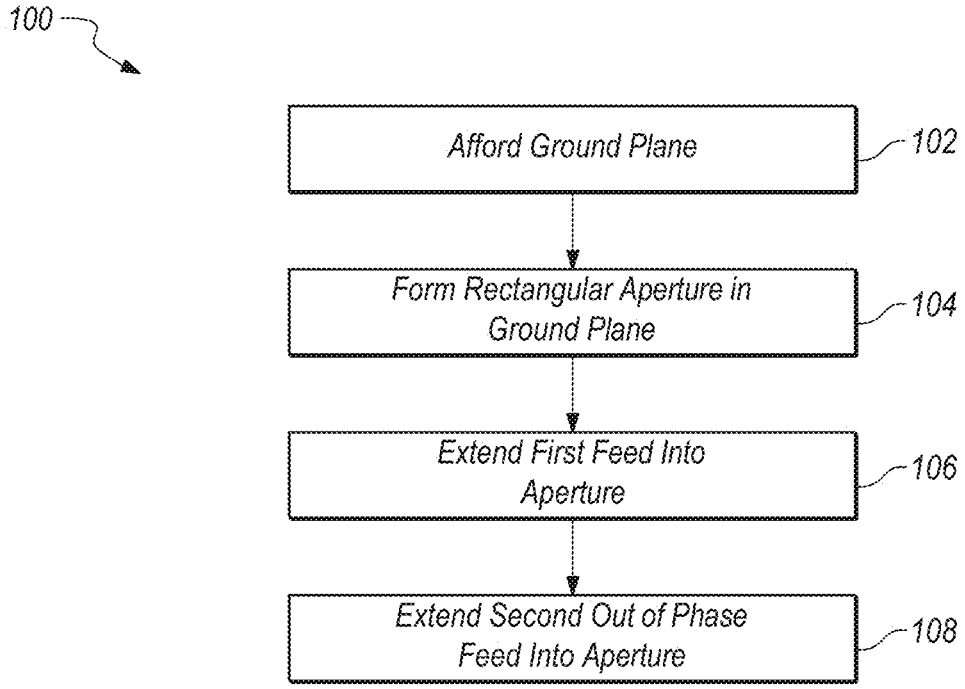

Referring now to FIG. 11, a block diagram is shown, which represents steps that can be taken to accomplish the methods of the present invention according to several embodiments. As shown, method 100 can include the initial step 102 of affording a ground plane and step 104 of forming a rectangular aperture (slot) in the ground plane. The methods can further include the steps 106 of extending a first feed and a second feed into the aperture, and then feeding the feeds out of 180° out of phase with each as depicted by step 108 of FIG. 11. These ground plane, slot and feeds can have the same structure and cooperation of structure recited above.

The use of the terms "a" and "an" and "the" and similar references in the context of describing the invention (especially in the context of the following claims) is to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A slot antenna comprising:

a ground plane formed with an aperture;

a first feed extending into said aperture;

a second feed extending into said aperture;

said first feed and said second feed terminating in said aperture such that said aperture is end fed by said first feed and said second feed, said second feed being aligned on the same axis as the first feed and being fed out of phase with said first feed such that said slot antenna provides a symmetrical omnidirectional radiation pattern over multiple frequencies when said slot antenna radiates, and said first feed and said second feed each defining a respective first and second U-shaped stub, wherein said first U-shaped stub and said second U-shaped stub each have a respective stub length, a stub width, a crossbar and a pair of stub tines extending from said crossbar, said stub tines defining a stub separation, and further wherein each said respective stub length, stub width and stub separation are selected to establish the symmetric omnidirectional radiation pattern for said slot antenna.

2. The slot antenna of claim 1, wherein said aperture is rectangular.

3. The slot antenna of claim 1, wherein said second feed extends into said aperture so that said second U-shaped stub tines are aligned on the same axes as said first U-shaped stub tines.

4. A method for generating a symmetrical radiation pattern for a wideband slot antenna, comprising the steps of:

A) affording a ground plane;

B) forming an aperture in said ground plane;

C) extending a first feed into said aperture so that said first feed terminates in said aperture and said aperture is end fed by said first feed;

D) extending a second feed extending into said aperture so that said second feed is aligned on the same axis as the first feed and is fed out of phase with said first feed, so that said second feed terminates in said aperture, said aperture is end fed by said second feed, and such that said wideband slot antenna provides a symmetrical omnidirectional radiation pattern over multiple frequencies when said wideband slot antenna radiates;

wherein said steps C) and D) are accomplished with a respective said first feed that defines a first U-shaped stub and a said second feed that defines a second U-shaped stub;

wherein said first U-shaped stub and said second U-shaped stub each have a respective stub length, a stub width, a crossbar and a pair of stub tines extending from said crossbar, said stub tines defining a stub separation; and, further wherein said step C) and said step D) are accomplished with each respective said stub length and stub width being selected to establish the symmetric omnidirectional radiation pattern for said wideband slot antenna.

5. The method of claim 4, wherein said aperture has an edge, and wherein said first crossbar and said second crossbar each have a respective stub separation from said edge.

6. The method of claim 5, wherein said second feed extends into said aperture so that said stub tines for said first feed and said second feed are aligned along the same axes.

7. The method of claim 4, wherein said aperture from said step B) is rectangular.

* * * * *